US006957577B1

(12) United States Patent
Firmin

(10) Patent No.: US 6,957,577 B1
(45) Date of Patent: Oct. 25, 2005

(54) DOWN-HOLE PRESSURE MONITORING SYSTEM

(75) Inventor: Cully Firmin, Lafayette, LA (US)

(73) Assignee: Nova Technology Corp., Inc, Broussard, LA (US)

( * ) Notice: Subject to any disclaimer, the term of this patent is extended or adjusted under 35 U.S.C. 154(b) by 0 days.

(21) Appl. No.: 10/959,835

(22) Filed: Oct. 5, 2004

Related U.S. Application Data

(63) Continuation-in-part of application No. 10/294,319, filed on Nov. 13, 2002, now abandoned.

(60) Provisional application No. 60/338,130, filed on Nov. 13, 2001.

(51) Int. Cl.[7] ..... E21B 47/06
(52) U.S. Cl. ..... 73/152.51
(58) Field of Search ..... 73/152.51, 152.46, 73/152.54, 152.52, 152.53, 152.55, 152.61, 73/152.62; 166/257, 261, 368

(56) References Cited

U.S. PATENT DOCUMENTS

| | | | | |
|---|---|---|---|---|
| 3,712,129 A * | 1/1973 | Rhoades | 73/152.53 |
| 3,985,027 A | 10/1976 | Tricon | 73/152.51 |
| 4,505,155 A | 3/1985 | Jackson | 73/152.51 |
| 4,722,363 A * | 2/1988 | Allyn | 137/601.18 |
| 4,976,142 A | 12/1990 | Perales | 73/152.52 |
| 5,163,321 A | 11/1992 | Perales | 73/152.52 |
| 5,209,300 A * | 5/1993 | Ayres | 166/305.1 |
| 5,582,064 A | 12/1996 | Kluth | 73/1.57 |
| 6,461,414 B1 * | 10/2002 | Kohl et al. | 96/156 |
| 6,851,444 B1 * | 2/2005 | Kohl et al. | 137/13 |

* cited by examiner

*Primary Examiner*—Hezron Williams
*Assistant Examiner*—Tamiko Bellamy
(74) *Attorney, Agent, or Firm*—Robert N. Montgomery

(57) ABSTRACT

A non-electric down-hole formation pressure monitoring system utilizing a typical down-hole chemical injection system for pressure data acquisition used with surface computer integration to produce an accurate picture of formation pressure variations utilizing pressure differentials across a pressure balanced valve located adjacent the chemical injection orifice. Computer controlled manipulation of the injection pump pressure maintains a constant differential pressure across the pressure balance valve thus tracking the well formation pressure deviations. The surface computer monitors pump noise, plumbing noise due to vibration, etc., temperature, and fluid and/or gas coefficients, and compensates for any adverse effects that may affect the accuracy of the formation pressures. Down-hole pressure monitoring is achieved in chemical injection or dedicated pressure-monitoring mode with only minor surface adaptations to the well chemical injection pump skid.

20 Claims, 9 Drawing Sheets

DOWN-HOLE PRESSURE MONITORING SYSTEM

FIELD OF THE INVENTION

This is a Continuation-In-Part application relying on applicant's previously filed non-provisional application Ser. No. 10/294,319 filed Nov. 13, 2002, now abandoned and its provisional application No. 60/338,130 filed Nov. 13, 2001, under 35 USC 120.

This invention relates generally to a method and apparatus for combining the monitoring of down-hole pressures in oil and gas well operations with chemical injection operations and more particularly to the utilization of a modified chemical injection system for injecting chemicals remotely into oil and gas wells while computing and accurately recording production tubing pressures at the bottom of the well, continuously, in real time.

GENERAL BACKGROUND

Bottom-hole pressure measuring and continuous monitoring in particular are invaluable in the management of oil and gas wells for fiscal projections, production exploitation, and the prevention of well or formation damage that can prematurely end the productive life of a hydrocarbon reservoir. Real-time pressure monitoring is essential to the prevention of costly service intervention in high capacity, deep-water, remote, and sub-sea wells. Elaborate and often expensive systems are deployed for the dedicated purpose of down-hole pressure monitoring. The typical preload of a conventional back-check valve or pair of valves designed for use in a down-hole chemical injection mandrel yields between 60 to 130 pounds per square inch. The hydrostatic weight of fluid combined with injection pressure typically present excessive forces that easily overcome the back-check valve spring load during even infinitesimal reductions in down-hole pressure.

Methods for monitoring down-hole pressures without interruption of production or injection operations were first tested in Germany several years ago. This initial development and its subsequent modifications required electric cable to transmit a signal reflecting down-hole pressures.

Bottom-hole pressure data are routine requirements for evaluation of production and reservoir performance. Monitoring of reservoir-pressure response may be especially helpful in evaluation and control of supplemental recovery projects. This might include producing, buildup, and static surveys as determined by pressure recorders run on wire line. However, frequency and number of wells conventionally surveyed may be limited due to interruption of normal production routine, as well as the expense of such interruptions. Presence of some artificial-lift equipment will prevent running conventional pressure surveys. Furthermore, production of highly corrosive fluids, together with potential damage from wire-line cutting where plastic-coated tubing is installed, can also be a deterrent to obtaining useful pressure data.

Where the expense can be justified, installation of permanent bottom-hole pressure monitors offers a means of securing such data.

Electrical methods, such as strain gauges to measure pressure, have been available in several forms for many years. In 1998, a taut wire gauge was developed and first received widespread use in Europe. The ends of the taut wire are attached to a sealed steel housing and a steel diaphragm. A current pulse transmitted down hole energizes the wire. As pressure is applied to the diaphragm, tension in the wire is changed with accompanying changes in natural frequency of the wire. An electrical signal is transmitted to a surface receiver for comparison with a signal from a standard calibrated wire for determination of the applied pressure. Detailed description of this equipment plus practical applications in the Rocky Mountain area has been well documented.

During 1959, a down-hole bourbon tube-type gauge was developed in the United States. As pressure is applied to the spiral formed tube, coupled to a code wheel made of an electrical conductor and an electrical insulator, a pattern change in current requirements is affected. By decoding the current pattern, the bottom-hole pressure can be determined.

In each of these methods, down-hole signals are transmitted to the surface by means of an electrical cable, which is normally attached to the exterior of the production or injection tubing.

More recently, a pressure gauge using a quartz transducer rather than a taut wire has become available for field applications. In even more recent developments, new tools have been introduced which do not use any down-hole electronics or electrical conduits by using a pressure-transmission system consisting of a 3/32-in. I.D. capillary tube attached to the outside of the production tubing. This small capillary tube connects a surface recorder to a down-hole chamber in communication with the well fluids.

In the pressure-transmission approach, a down-hole chamber is connected to a surface monitor by a small-diameter tube filled with a single-phase gas, usually nitrogen. The tube is normally secured to the outside of the production tubing, extended through a packing gland in the casing head, then to a surface-pressure recorder and optional digital readout unit. The down-hole chamber permits expansion and compression of the pressure-transmitting gas without entry of well fluids into the tube (FIG. 1). The size of the chamber is dependent on the anticipated pressure range to be encountered and the diameter of the tube. The capillary tube type is dependent on the down-hole environment. A protector or guard banded to the production tubing covers the tube at each collar.

As compressibility will vary with pressure and temperature, which also vary with depth, corrections must be provided for changes in these conditions throughout the anticipated pressure range to be recorded. A portable monitor and printer are generally used with the pressure-type monitoring system. As a side benefit, the combination monitor and printer can also be used for the recording of surface buildups or other pressure monitoring on wells which have no down-hole detector.

Wire-line pressure surveys are often run in permanent pressure monitored wells to determine the reliability of the results obtained with the permanent pressure transmission systems. Calibration is then required by adjusting the gas pressure in the capillary tube to compensate for the errors. Since pressure is sensitive to the prevailing temperature, it is essential that accurate temperature monitoring be achieved. Therefore, in current permanent pressure monitoring systems of this type, errors are prominent, especially in deep wells, and must be compensated for in the recording system by extrapolation.

In addition, tubing hanger penetration limitations often don't allow for the development of an electronic or optical down-hole pressure gauge.

The initial expense of permanent down-hole pressure monitors is greater than routine wire-line pressure surveys with installation expense varying with depth.

As a result of the expense and inefficiencies of the above-related systems, a more effective and less expensive permanent down-hole pressure monitoring system has been developed and disclosed herein.

SUMMARY OF THE INVENTION

Conventional chemical injection systems deploy selected chemicals in oil and gas wells for the purposes of controlling tubing corrosion, paraffin buildup, hydrate plugging, etc. Down-hole injection systems are typically comprised of a fluid reservoir, a surface pumping system, plumbing to the wellhead or sub-sea umbilical, a capillary tube attached to the exterior of the production tubing string, a ported mandrel installed in the tubing string, and a complement of back-check valves that prevent down-hole fluid ingression into or through the injection system.

The invention disclosed herein is an improved cost effective system and method for acquiring accurate, bottom-hole pressure in oil and gas wells. The described invention is ideal as backup to an electronic or fiber-optic monitoring system in high-profile applications, it is an economical alternative to provide valuable reservoir data for budget constrained projects and is viable for hostile environment applications where temperature and/or pressure extremes compromise the reliable operating life of electronic or fiber-optic instruments. By utilizing typical down-hole chemical injection system technology as the basis for pressure data acquisition, combined with surface computer integration, a constant, accurate picture of formation pressure variations may be obtained at minimum cost. Pressure variations in the chemical injection capillary tube mimics formation flow characteristics which may be monitored by the computer at the surface where pump noise and plumbing vibrations, etc., are suppressed or filtered out, temperature and fluid and/or gas coefficients are monitored and compared to compensate for any adverse effects which may affect the accuracy of the formation pressures being monitored. Non-electric down-hole pressure monitoring is therefore possible with this system in chemical injection mode or in a dedicated pressure-monitoring mode by making only minor surface adaptations to the well chemical injection pump skid.

The disclosed invention provides an innovative means for measuring and continuously monitoring the down-hole pressure at the ported chemical injection mandrel. Completely unlike previous pressure transmission systems, the described invention utilizes balanced compression of the capillary media between the natural down-hole pressure source and a tracking, surface-controlled injection pressure source. The depicted system is effective with any type of media permitting the selection of optimum fluids that address the chemical injection demand. Incompressible media behaves like a solid, transferring pressure changes with excellent transient response and high resolution. Compressible media at significant pressures with a sufficient degree of achieved compression behave similarly, with quick transient response for a hydraulic pressure measuring system. Compressible media at low pressures will alleviate transients and result in sluggish change response for continuous monitoring applications, but will provide comparably accurate sustained measurements where pressures are stable. The depicted system does not require special down-hole equipment and provides the pressure monitoring function concurrent with the continuous or intermittent injection of chemicals at desired rates. Neither the absence of, nor the inclusion of, a check-valve(s) (regardless of quantity) adversely affect system operation. The effects of volume variations caused by capillary and/or umbilical hose swelling are compensated within the measurement process. The typical preload of a conventional back-check valve or pair of valves designed for use in a down-hole chemical injection mandrel yields between 60 to 130 pounds per sq. inch. The hydrostatic weight of fluid combined with injection pressure typically present excessive forces that easily overcome the back-check valve spring load during even infinitesimal reductions in down-hole pressure. The effect of hydrostatic pressure is corrected by calculation. The overall effect of fluid density is summed and compensated in the compressive measurement process. With a determined down-hole pressure minimum and sufficient hydrostatic pressure, a smooth pressure response devoid of "crack pressure" cycling is recorded at ultra low injection rates. The analysis of cyclic behavior is exempt in this condition and the resulting performance is excellent for dedicated down-hole monitoring. The cyclic behavior can be prominent in applications where the media is light and compressible, where hydrostatic offsetting power-spring valves are deployed, and where yield points and fluid friction reflect pump back-pressure surges proportional to injection rates and pump stroke displacement. Many wells can benefit from the smooth, dedicated monitoring function through the early producing reservoir life pending the need for chemical inhibition or treatment. Where cyclic response occurs, the processing system identifies the moment of equalization, follows the check opening, and determines that the balance valve pressure is equal to the down-hole pressure source.

The effects of fluid friction are compensated by calculation at fixed rates with simple system configurations or by sophisticated algorithms with computer-controlled systems for variable injection rates. A novel combination of complementary instruments integrated within, or added to the chemical injection system is required to derive the described pressure monitoring function. Simple system configurations utilizing this innovative pressure measurement and monitoring method derive modest but beneficial performance specifications. The more sophisticated system configurations derive significantly enhanced performance characteristics, including greater accuracy and improved resolution.

BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

DETAILED DESCRIPTION OF THE PREFERRED EMBODIMENT

Figure 1:
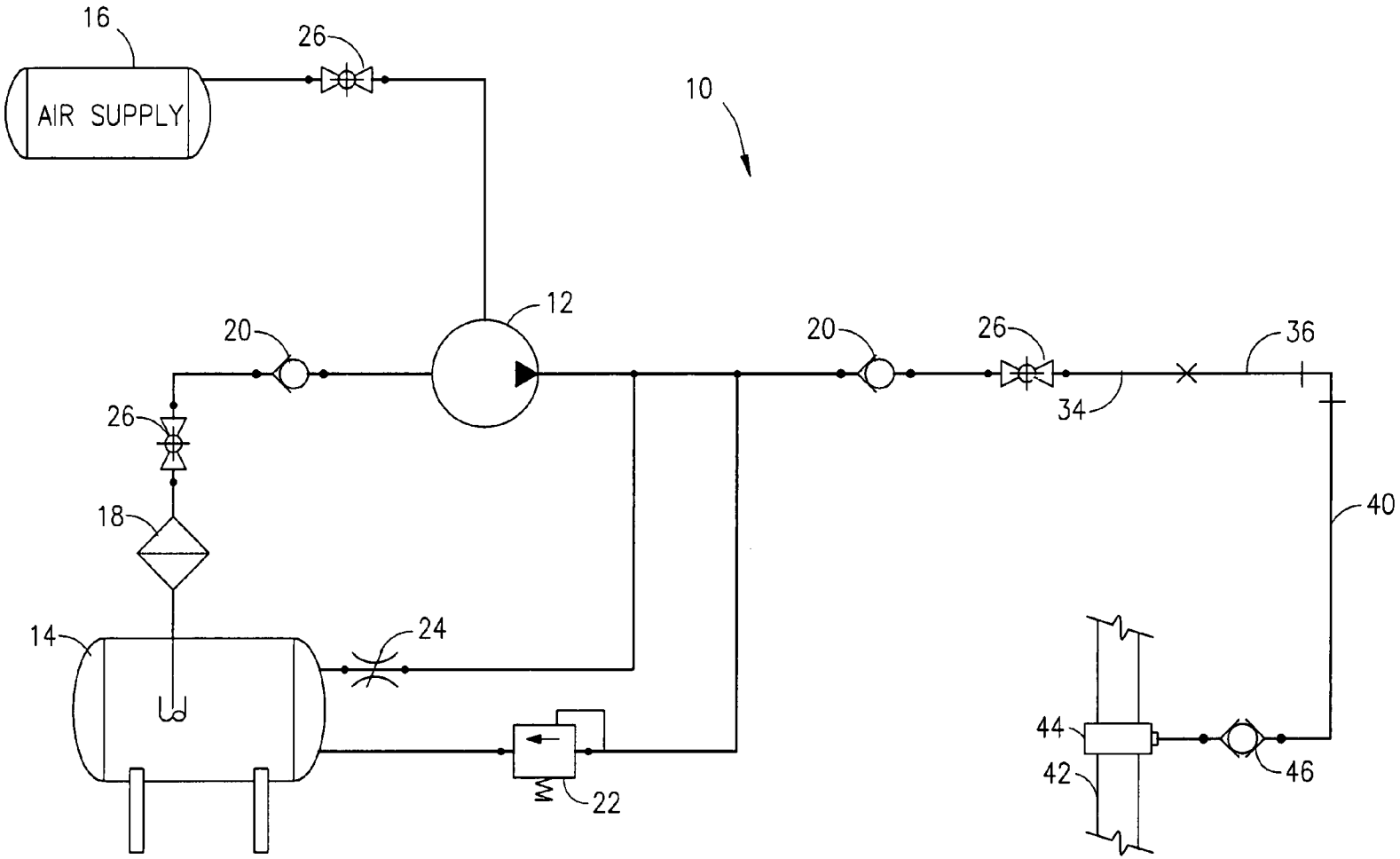
FIG. 1 is a schematic diagram of a typical chemical injection module.
Figure 2:
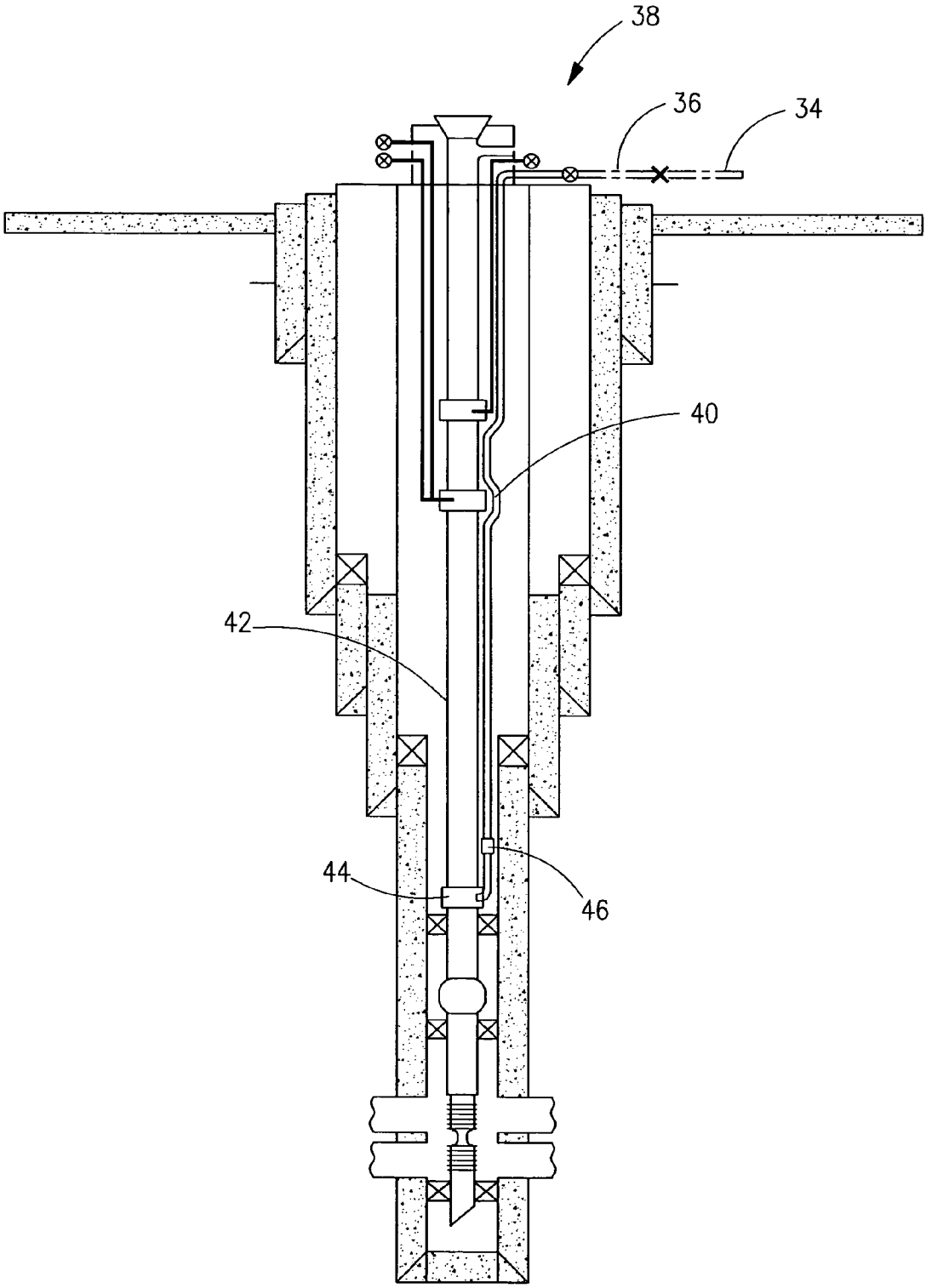
FIG. 2 is a cross section of a well with chemical injection capability.

An improved, permanent down-hole pressure monitoring system is disclosed that utilizes a modified oil and gas well chemical injection system. A basic chemical injection system or chemical pressure monitoring system (CPMS) 10, as illustrated in FIG. 1, includes a relatively low volume, high pressure injection pump 12, a chemical reservoir 14, an air supply 16, and the usual suction and discharge filters 18, check valves 20, safety valve 22, needle valve 24, and cutoff valves 26. Chemicals are discharged from the pump 12 through the discharge line 34 making external connection 36 with a chemical umbilical line leading to the wellhead 38. As seen in FIG. 2, a capillary tube 40 extending externally along the production casing 42 terminates at an injection port 44 near the bottom of the well formation, as shown in FIG. 1. Fluid flowing upwards through the production casing 42 is prevented from entering the chemical injection capillary tube by a down-hole double check or balance valve 46. Typically in operation, when chemicals from the chemical reservoir 14 are needed in the production tubing to prevent excess paraffin build-up, corrosion, hydrate plugging, or otherwise help improve production fluid flow, the injection pump 12 is activated, whereby the external connection 36 and capillary tube 40 with a column of fluid or gas, to an extent sufficient to overcome or crack the differential across the down-hole double check valve 46, and allows the chemicals to enter the production casing 42. The pressure required to overcome or to crack the pressure differential across the remote down-hole check or balance valve 46 is a fairly good indicator of the formation fluid or gas pressure in the production tubing. However, the formation production flow pressure relative to chemical injection pressure reading at the surface is not sufficiently accurate to serve any useful purpose. There are a great many adverse factors that must be taken into account before any real correlation can be made.

Figure 6:
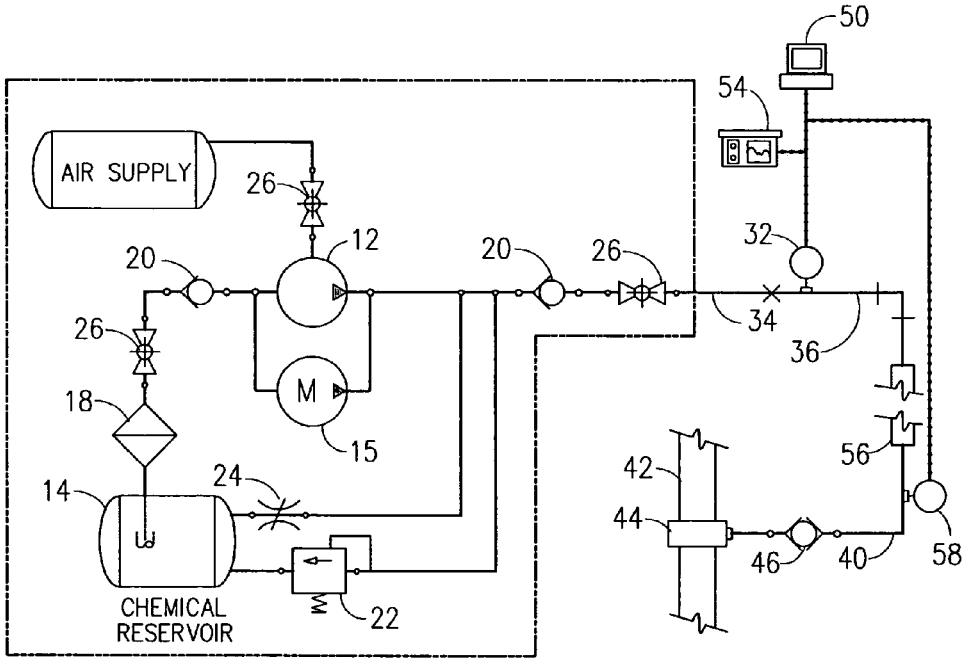
FIG. 6 is a diagram of one the embodiments of the chemical injection module.
Figure 7:
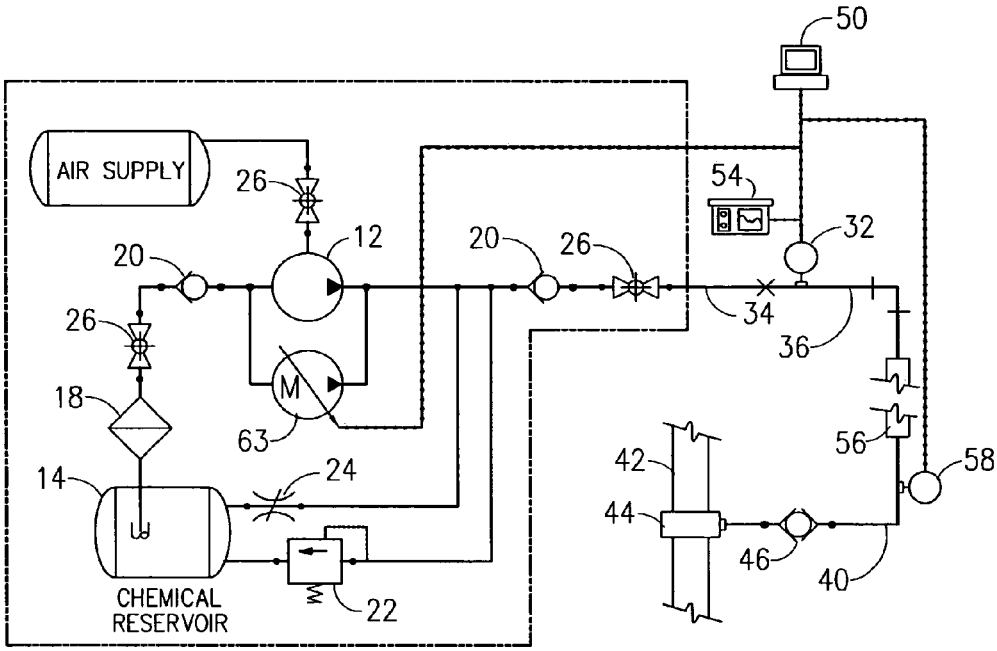
FIG. 7 is a diagram of one the embodiments of the chemical injection module.
Figure 8:
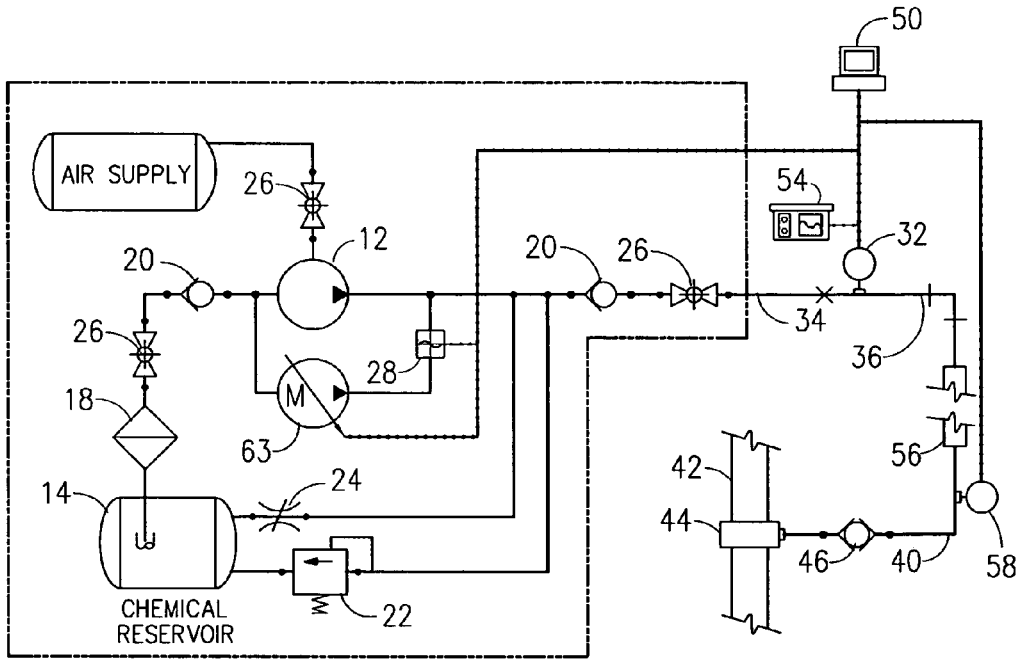
FIG. 8 is a diagram of one the embodiments of the chemical injection module.
Figure 9:
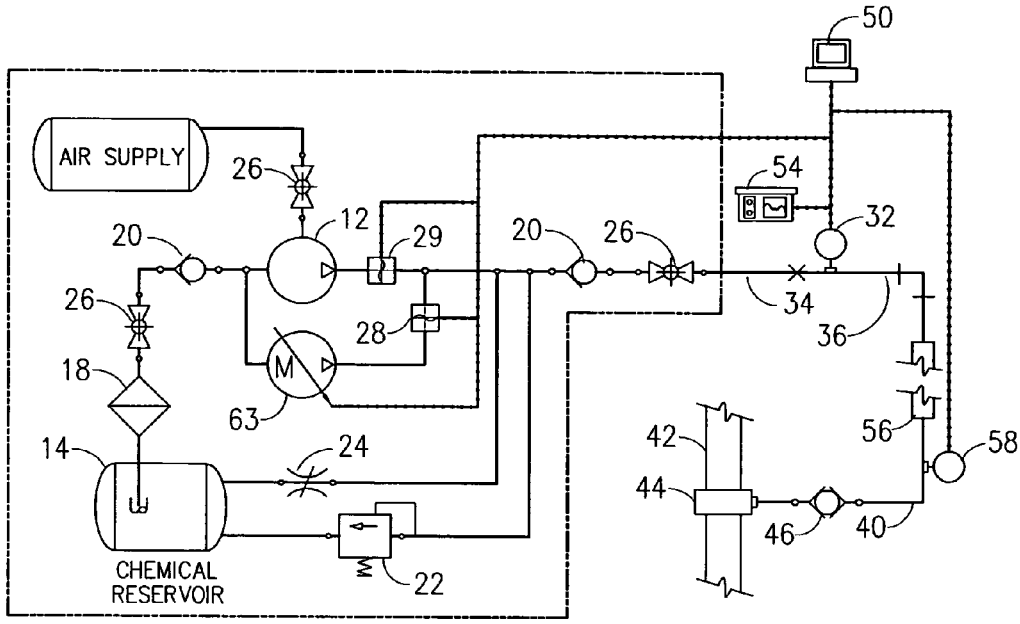
FIG. 9 is a diagram of one the embodiments of the chemical injection module.
Figure 10:
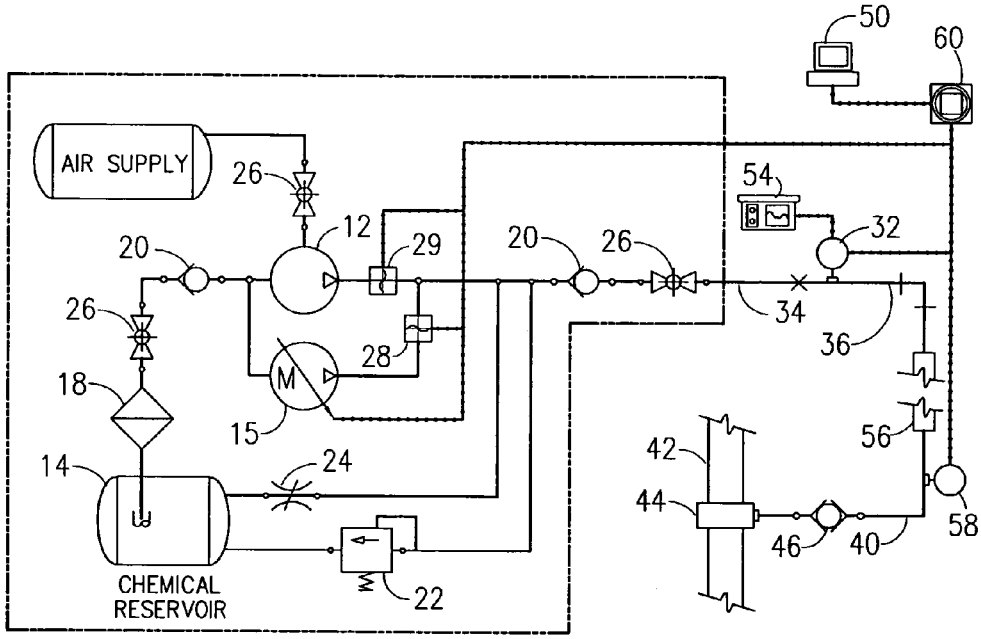
FIG. 10 is a diagram of one the embodiments of the chemical injection module.

To obtain useful non-electric sensing of bottom or down-hole production fluid formation pressure using the data from the chemical injection system 10, the system must utilize a constant source of variable pressure, such as a variable displacement-metering pump 15 as first seen in FIG. 6. By maintaining a tracking static pressure on the capillary tube 40, specific data relating to the well may be generated for comparison with previously acquired or extrapolated data. Such data may include the following elements derived from the following equations;

□=density of the injectate g=acceleration due to gravity v=velocity of flow

□=pipe roughness $h_L$=head loss due to friction h=depth of the well (TVD)

□=viscosity of the injectate $$P_{res} + P_{friction} = P_{pump} + P_{hydrostatic}. \quad (1)$$

$$P_{res} = \text{unknown}$$

$$P_{pump} = \text{measured}$$

$$P_{hydrostatic}. \square g\ h$$

$$P_{friction} = \square g\ h_L \quad (2)$$

Where,

Darcy-Weisbach equation $$h_L = \frac{fLv^2}{2gD} \quad (3)$$

and f $$f = \frac{64}{Re} \text{ for laminar flow} \quad (4)$$

And for turbulent flow

Colebrook-White equation (1937): an implicit equation $$\frac{1}{\sqrt{f}} = -2\log\left[\frac{\varepsilon/D}{3.7} + \frac{2.51}{Re\sqrt{f}}\right] \quad (5)$$

Colebrook Approximation: an explicit equation $$f = \frac{1.325}{\left(\ln\left(\left(\frac{\varepsilon/D}{3.7}\right) + \left(\frac{5.74}{Re^{0.9}}\right)\right)\right)^2} \quad (6)$$

$$-10^{-6} <= \square/D <= 10^{-2};\ 5000 <= Re <= 10^8 \text{ and}$$

$$Re = \frac{\rho v D}{\mu} \quad (7)$$

The pressure and flow-rate data sets collected and established by the above formulas may then be combined with other data sets for comparison.

Figure 3:
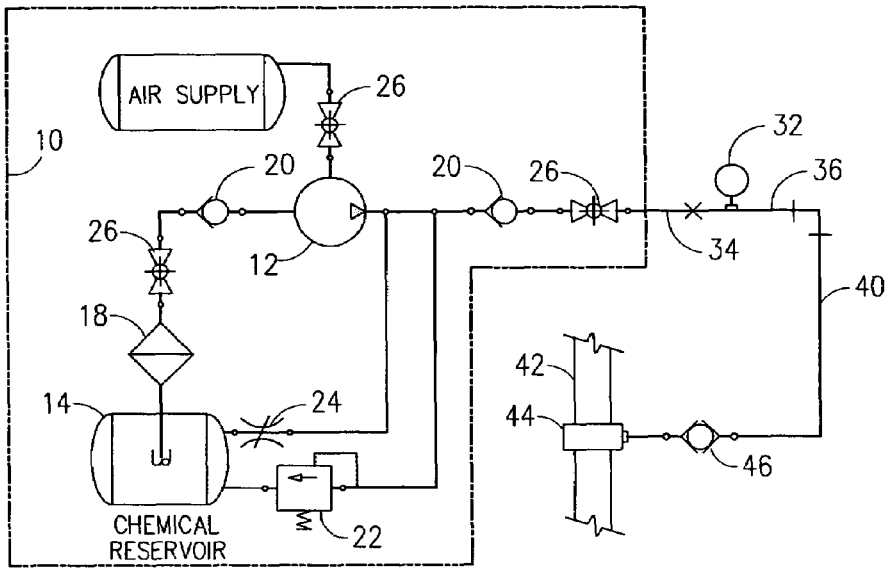
FIG. 3 is a diagram of one the embodiments of the chemical injection module.
Figure 4:
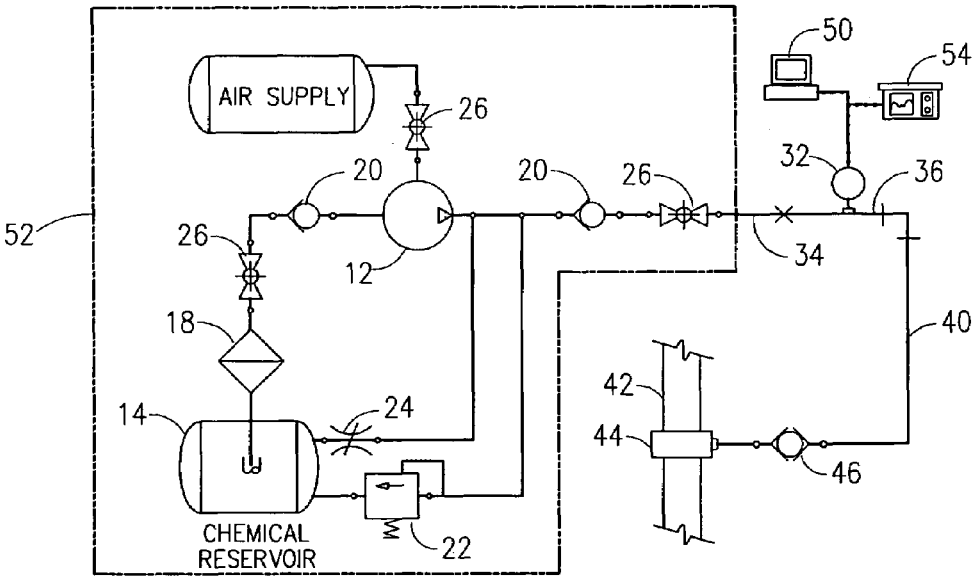
FIG. 4 is a diagram of one the embodiments of the chemical injection module.

It should be understood that although some useful down-hole pressure and chemical flow-rate data may be obtained by utilizing the chemical injection system 10 as described in FIG. 1 with manual manipulation of the primary chemical injection pump 12 in combination with a pressure transducer 32, as shown in FIG. 3, for monitoring the pressure on the down-hole capillary tube 40, more accurate data may be obtained by utilizing a remote computer acquisition system 50, as seen in FIG. 4, integrated into a modified chemical pressure monitoring system 52, also shown in FIG. 4. The remote acquisition computer 50 receives data from the pressure transducer 32 in combination with a local indicator or chart recorder 54. In this manner it is possible to monitor the dynamic pressure on the chemical injection capillary tube 40 from the surface of the well by allowing the injection pump 12 to track formation flow fluctuations up or down, thereby providing automatic dynamic control.

The basis for the current, more efficient permanent pressure monitoring system as seen in FIGS. 6–12 is to provide a means for operating in two modes: A pressure monitoring mode and a second mode, whereby both pressure monitoring and chemical injection are taking place simultaneously. Obviously, a more accurate pressure recording is possible in mode 1. However, both modes are essentially the same except that in mode 2 the computerized system compensates for friction drop variables due to injection rate and temperature variation.

Figure 12:
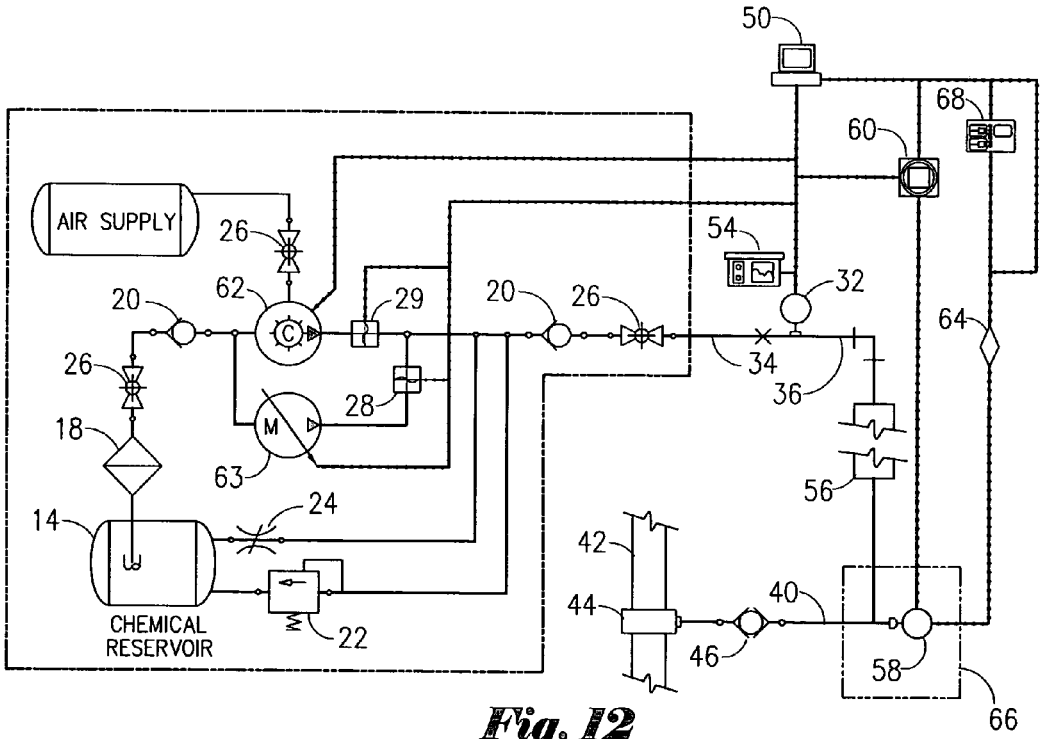
FIG. 12 is a diagram of one the embodiments of the chemical injection module.

Integration of some means for temperature sensing would obviously enhance the system and may be achieved in any number of ways, the preferred of which is a distributed temperature sensor (DTS) 68. A DTS system 68, as seen in FIG. 12, in this application would locate a fiber optic sensor in the chemical injection capillary tube 40, thereby further enhancing the accuracy of the pressure recording and improving the temperature coefficient based on a particular fluid density. These correlations between fluid density, viscosity and temperature are prerecorded in the computer's software database 50*a*, utilizing the above mentioned formula.

Figure 5:
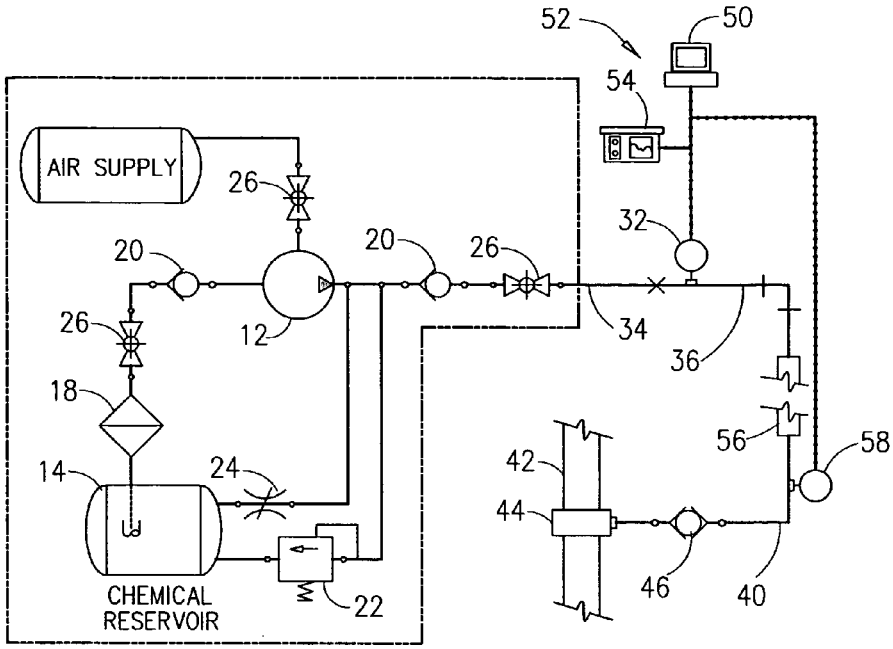
FIG. 5 is a diagram of one the embodiments of the chemical injection module.

Another important factor is the hydrostatic pressure on the capillary tube 40 as measured by a sub-sea pressure transducer 58, the umbilical yield point on line sub-sea umbilical lines 56 and horizontal external tubing connections 36, all of which must be compensated for in the computer software 50*a* in sub-sea environments, as seen in the FIG. 5 diagram.

The chemical pressure monitoring system 52 is effective when used with either a gas or a fluid as the injection tube or capillary media. The fluid in the capillary tube 40 varies with the chemical injection rate and the computer software is designed to compensate for fluid friction pressure drop. Therefore, the pump 12 may be used to automatically compensate for pressure variables in the capillary tube 40, thereby eliminating the problem of tube swelling or contraction.

Another important factor that must be overcome is surface pump pressure noise resulting from sub-sea umbilical lines 56 and horizontal external tubing connections 36 on the well platform. This problem is anticipated and compensated for by providing pulse dampening in the combination of discharge line 34 and capillary tube 40. Also by providing noise filters in the computer software 50*a* to smooth out the recorded pressure readings.

The Chemical Pressure Monitoring System (CPMS) 52 as disclosed herein nullifies and/or eliminates any errors that may result from the Bernoulli effect taking place in the chemical injection system 10. The production fluid from the well passing upwards through the production casing 42 by passing over the chemical injection port 44, seen in FIG. 2, thereby creates a vacuum on the down-hole double check or balance valve 46, seen in FIG. 1. This eliminates the need for modeling the characteristics of the balance valve 46. By controlling the injection pump 12 speed or volume pressure in the chemical injection capillary tube 40 connected to the down-hole double check valve 46, a near zero differential relative to the well fluid pressure may be maintained across the balance check valve 46. Therefore, to achieve chemical injection into the production fluid, pressure is increased in the capillary tube 40 to overcome the well fluid pressure. When monitoring the well fluid pressure only, the balance valve 46 is held in a neutral state. It should be understood that the modified chemical injection system 52 works equally as well with or without a double check valve 46 being in the system. Although most chemical injection systems 10 rely on one or more check valves for various safety reasons, the modified chemical injection system 52, as disclosed herein, depicts the balance check valve 46 as one of the system elements.

As previously discussed and seen in FIG. 1, a typical chemical injection pump system 10 utilizes a static fixed displacement pump 12. This new system can be utilized with the chemical injection system, seen in FIG. 3, with manual manipulation by an operator in cooperation with a computer recording or charting system 54, seen in FIG. 4, to compensate for the various factors stated herein. Clearly, a more efficient computer controlled variable volume metering pump 63 enhances the system by monitoring the remote capillary tube's differential pressure and eliminates the need for an operator, thereby making the system fully automatic. Other types of pumps may also be used such as a variable displacement type.

Since the permanent formation pressure monitoring system or continuous chemical pressure monitoring system (CPMS) 52 is effectively integrated with the chemical injection system 10, it should be understood that the CPMS 52 does not interfere with the chemical injection system 10 in any way. The pressure monitoring system 52 simply monitors the chemical injection system 10 and compensates for any adverse effects that tend to affect the accuracy of the well pressure reading.

Wells that are fitted with chemical injection systems 10 in their early stages, for use at a later time, may now utilize such systems as a dedicated well pressure monitoring system for chemical injection. In such cases, the system computer 50 is programmed to compensate for the friction drop based on temperature and fluid coefficients for the type of chemicals and fluid viscosity being used. These friction coefficients are developed by lab experiments for various types of fluids and their reactions at various temperatures in various types of conduits.

When comparing pressure gauge logs with the Chemical Pressure Monitoring System (CPMS) 52, it was found that the CPMS system traced fluctuations of pressure down-hole with a 95% accuracy rate. However, as with any point-to-point measurement, progression errors do occur. Therefore, by establishing a starting reference data line in the CPMS computer 50, each data sample is compared to the starting data point, thereby eliminating progression errors.

It is anticipated that the CPMS system 52 will be 100% accurate when all time lapses and frictional coefficients have been integrated into the system for a particular well.

Figure 11:
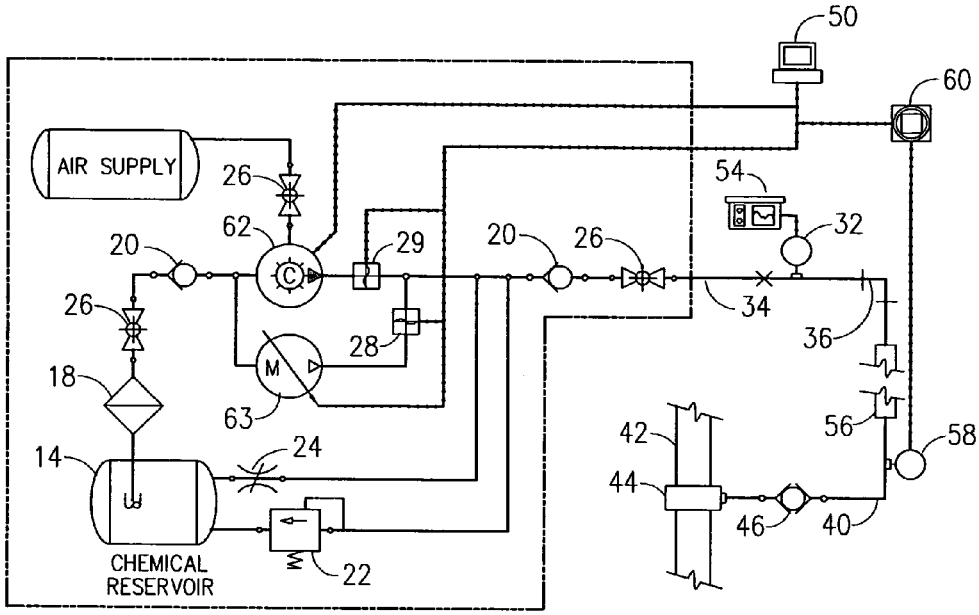
FIG. 11 is a diagram of one the embodiments of the chemical injection module.
Figure 13:
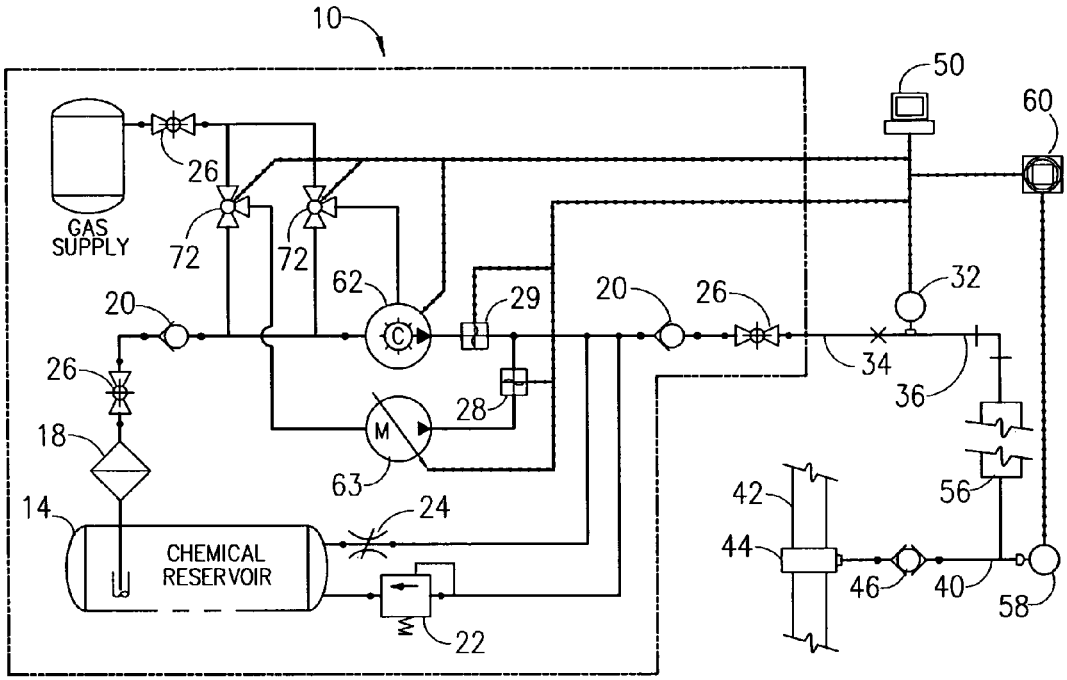
FIG. 13 is a diagram of one the embodiments of the chemical injection module.
Figure 14:
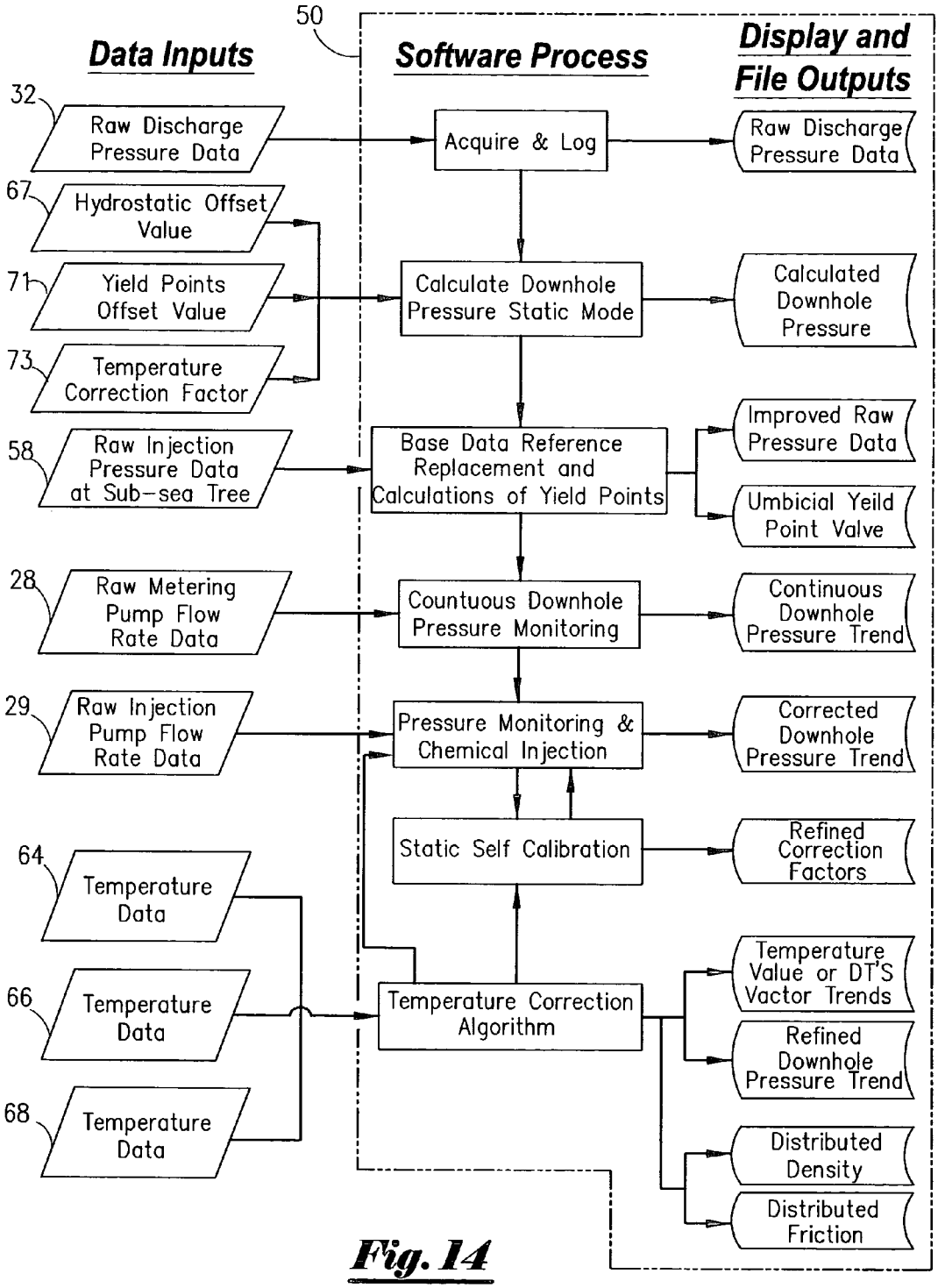
FIG. 14 is a data flow diagram.

In operation, the high-pressure injection pump 12, seen in FIG. 1, is engaged to apply pressure and fluid displacement sufficient to establish overriding injection pressure into the production casing 42, seen in FIG. 2. During the initial application of pressure and displacement of chemical in the injection line 34, 40, an increase in pressure from the injection pump 12 with pulses corresponding to pump stroke displacement is observed by the flow meter 28 and pressure transducer 32, first seen in FIG. 9, or other such means until production casing communication is attained. The chemical pressure continues to build until the opposing forces of the facility plumbing yield point are overcome, consisting of the umbilical yield point (applicable to sub-sea applications), the mechanical force sum of down-hole double check or balance valve 46, tube swelling volume displacement, and the down-hole pressure at the injection port 44. Tube and/or hose swelling affects are reduced to the interval of time required to establish well-bore fluid communication (injection). The subsequent detection of flow communication into the well bore is easily discerned in the measured pressure data. Once pump pressure combined with the hydrostatic weight of the injection fluid column establish communication through the double check or balance valve 46, a moment of pressure equilibrium occurs against the down-hole pressure source. Continued pumping action again increases the pressure applied causing this cycle to repeat. The toggling action between the higher pressures required to establish communication and the lower equalized pressure immediately following the actual injection event is observed on the pressure gauge and/or recording device 54. Display of pressure value may be a conventional oil-filled gauge or transducer 32, as seen in FIG. 3, a local process meter 60, as first seen in FIG. 10, an electronic recorder 54, as seen in FIG. 4, a printer connected to the computer-based acquisition system 50. Although a conventional gauge can be used to take measurements through manual execution of the depicted process, suitable electronic pressure transducer 32 and acquisition systems are recommended for manual control applications and required for continuous monitoring as shown in FIG. 4. The hydrostatic pressure is determined by empirical test or predicted through calculation as seen in FIG. 14. The resulting hydrostatic offset value 67 is added to the raw data measurement recorded or noted from the pressure gauge or transducer 32. The fluid friction pressure drop is calculated and the value added to the sum of the hydrostatic offset value 67 and the raw pressure measurement. Pressure measurements of greater accuracy can be obtained by reducing the injection flow rate to a minimum and thus reduce or negate the friction pressure drop error. With a determined down-hole pressure minimum and sufficient hydrostatic pressure, a smooth pressure response devoid of "crack pressure" cycling is recorded at ultra low injection rates. The analysis of cyclic behavior is exempt in this condition and the resulting performance is excellent for dedicated down-hole monitoring. The cyclic behavior can be prominent in applications where the media is light and compressible, where hydrostatic offsetting power-spring valves are deployed, and where yield points and fluid friction reflect pump back-pressure surges proportional to injection rates and pump stroke displacement. Many wells can benefit from the smooth, dedicated monitoring function through the early producing reservoir life pending the need for chemical inhibition or treatment. In sub-sea applications, first seen in FIG. 5, a pressure transducer 58 tapped into the chemical line 40 at the sub-sea tree enhances transient response and accuracy by excluding the umbilical and topsides plumbing yield points. Pressure transducers 32 located at both the injection line 36 and the sub-sea tree provide an accurate determination of the combined yield points 71 seen in FIG. 14. This is invaluable, as the yield point due to the umbilical lines 51 adhering to the variable topography of the sea floor is not easily predicted. For new wells, involvement in the well test process with a portable version of the chemical pressure monitoring system 52 establishes reference production data and down-hole pressure baselines traceable to the eventual umbilical line termination point resulting in more accurate correction factor and offset determinations. The addition of a positive displacement metering pump 15, seen in FIG. 6, capable of minute injection flow rates provides an optimum static pressure measurement capable of the highest measurement accuracy attainable. A manually controlled metering pump 15 may be used, but pressure measurements will produce an accruing error as down-hole pressure deviates from a particular setting. Manual readjustment will be required to track changes in down-hole pressure. An electronically controlled variable volume metering pump 63, seen in FIG. 7, operated automatically by a computer system 50 programmed to dynamically respond to changes in down-hole pressure is recommended. By halting the primary high-volume injection pump(s) 62 and establishing production casing 42 in communication with the ultra low-volume, low-rate variable metering pump 63, measurements are taken at an ultra low injection flow rate where the fluid friction pressure drop is reduced to an insignificant value. Following confirmed production casing communication, halting the positive displacement metering pump 15, seen in FIG. 5, will result in an ideal static no-flow condition with a capture of raw data devoid of any friction pressure drop (zero flow-rate). The natural closing of check-valves 46 at this moment of pressure equilibrium has no detrimental affect. The measurement derived by this static method provides a baseline for friction pressure drop correction. The addition of an ultra-low rate capable flow meter 28, first seen in FIG. 8, in line with an electronically controlled version of the variable displacement-metering pump 15 enables automatic control routines via the computer system 50, greatly enhancing monitoring capability and reducing manual intervention to obtain baseline measurements. The addition of a high-rate flow meter 29, as first seen in FIG. 9, capable of the intended injection rate span extends the continuous monitoring capability to operate concurrently with chemical injection. Chemical injection parameters are not limited by the modified chemical monitoring system 52 thus may be set for optimum well maintenance requirements. Manual calculations are acceptable for detection of deviations from a set down-hole pressure and injection rate. A software algorithm that utilizes measured injection flow rate data and the static calibration value performs real-time compensation for fluid friction pressure drop and backpressure associated with changes in the injection rate and/or down-hole pressure. Pressure and volume indicators local to the pumps and flow meters are a system enhancement that provides redundancy for measurement integrity verification and convenient displays for system setup, modeling, retrofit, troubleshooting, and well intervention. The static pressure measurement and the real-time flow rate value are factored to correct the down-hole measurement at various injection rates with dynamic friction pressure drop compensation. New static pressure measurements taken at predetermined intervals or alternating cycles enables a calibration function in the monitoring computer software 50*a*. When the computer system 50 is expanded, as seen in FIG. 11, to encompass automated variable control over the variable displacement primary injection pump 62 rate and the variable volume metering pump 63, an automatic self-calibration routine can be configured in the computer system software 50*a*. Temperature corrections 73 of the pressure measurement are made by conventional equations including predictions based on logging measurements. Fluid density ultimately affects the hydrostatic pressure and its frictional effects are distributed through the capillary length as a function of temperature. The addition of a thermocouple 64, resistance temperature device (RTD) 66, or preferably a fiber-optic distributed temperature sensing (DTS) system 68, as shown in FIG. 12, enhances the modified chemical injection system 52 with a real-time temperature measurement near the injection point to improve pressure measurement accuracy. Computer system software 50*a* further refines the conditioned pressure data with the temperature measurement as opposed to applying a predicted constant or average value. The DTS system 68 provides the base benefit of its inherent design, delivering a temperature profile throughout the entire length of optical fiber. As a novel application, the distributed temperature measurement can be processed with directional well information through a software algorithm to determine the distributed fluid density and friction coefficient characteristics for further refinement of pressure measurement and behavioral response modeling and compensation. In applications where down-hole pressure falls below the hydrostatic weight of the injection fluid column, a noble gas feed subsystem is added to the chemical injection/pressure monitoring system, as seen in FIG. 13. Nitrogen is the common choice with many facilities already equipped with a Nitrogen gas supply 70 controlled and fed to the injections system through valves 72 in the manner shown in FIG. 13. Concurrent chemical injection is still permissible, but only in an alternating cyclic mode that permits complete injection (evacuation) of the chemical before taking a pressure measurement with the gas media. An unknown fluid level equates to an unknown hydrostatic weight (head pressure) resulting in a corresponding offset error. The volumetric quantity of chemical injected through the gas-filled capillary tubes 40, valves 72, injection port 44, and into the production casing string 42 remains known and controlled. The computer-based automated system 50 is essential for continuous monitoring, but manual execution of the process will derive acceptable single-point measurement results for many well management applications. The automated fluid/gas switching method of operation will reduce sample resolution to the measurement cycle rate. Ultimately, at a given sample interval the minimum peak discharge pressure measurement following production tubing communication, plus hydrostatic pressure, plus fluid friction pressure drop, temperature corrected equals the down-hole pressure at the injection port.

The computer system software 50*a* monitors the system as disclosed herein, acquires input data from technical personnel, on site calculations, such as the hydrostatic offset value 67, the yield point offset values 71, and the temperature correction factor 73 and from the various sensing elements such as: 28, 29, 32, 64, 66 and 68. The input data is then processed by a proprietary software program installed on a topside remote computer system 50 or a sub-sea computer with input to the topside computer system 50 for display and/or file outputs as shown in FIG. 14. The computer system software 50*a* is used for storing collected data and comparing this data with prior recorded data sets. The data computations comprise chemical density, gravity acceleration, flow velocity, tubular roughness, hydraulic head pressure, pressure drops due to friction, yield points, well depth, and chemical viscosity. The computer software 50*a* monitors and records down-hole well pressure fluctuations by monitoring chemical pressure, performing analytical analysis of real time chemical injections using correction formulas, and comparing previous data sets for real time chemical injection adjustments. The chemical pressure is automatically variably responsive to fluctuations in well pressure acting on the double check valve 46 and performs corrective analytical algorithms through the computer software, thereby capturing pressure valve pressure compensation at the moment of equalization.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A chemical injection system for a well production string comprising:

a) a chemical injection system having a chemical reservoir and a primary chemical injection pump connected to the chemical reservoir;

b) a capillary tubing string connecting the primary chemical injection pump to at least one check valve ported to an injection mandrel fluidicly connected to the production string, the check valves and injection mandrels—located at strategic points within the production string extending down-hole into an oil and gas producing formation; and c) a computer means associated with the chemical injection system for monitoring the chemical—pressure and controlling the injection system in a manner whereby chemical pressure applied to at least one down hole check valve is maintained at a chemical pressure precisely equal to the pressure within the production string.

2. The chemical injection system according to claim 1 wherein the chemical injection further comprises a supplemental high-pressure metering pump.

3. The chemical injection system according to claim 1 wherein said chemical injection system further comprises a flow meter connected to the high pressure metering pump.

4. The chemical injection system according to claim 3 further comprises a pressure transducer.

5. The chemical injection system according to claim 4 wherein the computer means further monitors and controls the flow rate of the chemical.

6. The chemical injection system according to claim 5 wherein said computer means further comprises means for storing chemical pressure fluctuation data analyzing the data and automatically adjusting the supplemental injection pump pressure and flow to override the check valve and inject a chemical fluid into the production string.

7. The chemical injection system according to claim 6 wherein said computer system further includes data computations that comprise chemical density, gravity acceleration, flow velocity, tubular roughness, hydraulic head pressure, pressure drops due to friction, yield points, well depth, and chemical viscosity.

8. A chemical injection system for a well production string comprising:

a) a chemical injection system comprising a chemical reservoir and a primary chemical injection pump connected thereto;

b) a capillary tubing string connecting the chemical injection system to at least one injection mandrel having a check valve therein located within the production string; and c) a computer means associated with said chemical injection system for regulating, and maintaining a chemical fluid pressure on the check valve equal to varying pressures of the well production flow stream thereby establishing and maintaining a near zero differential across the check valve, the computer further having program means for comparing the chemical pressure fluctuations to historical data and adjusting chemical pressure and flow to override the check valve and enter the production string as necessary to ensure proper well flow charterristics.

9. The chemical injection system according to claim 8 wherein said means for maintaining a near zero differential across the check valve is a secondary high-pressure metering pump controlled by the computer means.

10. The chemical injection system according to claim 9 further comprising a flow meter and a pressure transducer connected to said high-pressure metering pump.

11. A method for obtaining useful real time bottom-hole oil and gas pressure fluctuations from a production well by monitoring a chemical injection system pressure comprising the steps of:

a) installing a chemical injection system on a production oil and gas well comprising:

i) a chemical injection system comprising a chemical reservoir and a primary chemical injection pump connected thereto;

ii) a capillary tubing string connecting the chemical injection system to a ported injection mandrel having at least one double check valve therein located near the lowermost point of the production string extending down-hole;

iii) a supplemental pump means associated with the chemical injection system for regulating and maintaining a static pressure on the check valve in a manner whereby chemical pressure on one side of the check valve is equal to down-hole oil and gas pressure on the opposite side of said check valve; and iv) a computer comprising means for monitoring and recording down-hole well pressure fluctuations by monitoring chemical pressure fluctuations, performing analytical analyzes and comparing instant by instant recorded data with previously recorded data sets and automatically controlling the injection system for real time chemical injection adjustments based on the analytical analyses;

b) pressurizing the chemical injection system and adjusting the supplemental chemical pump to maintain pressure on a chemical, acting on one side of the check valve, equal to the well pressure on the other side of the check valve;

c) monitoring the chemical injection system and periodically adjusting and recording chemical pressure changes resulting from well pressure fluctuations; and d) applying analytical data correction formulas to the pressure changes to derive a more accurate picture of the well production characteristics.

12. The method for obtaining useful, real time bottom-hole oil and gas pressure fluctuations from a production well according to claim 11 wherein the pressurized chemical exerted on the down-hole check valve in a gaseous state.

13. The method for obtaining useful, real time bottom-hole oil and gas pressure fluctuations from a production well according to claim 12 wherein the chemical injection is automatically responsive to fluctuations in well pressure acting on the down-hole check valve.

14. The method for obtaining useful, real time bottom-hole oil and gas pressure fluctuations from a production well according to claim 13 wherein the computer-further compensates for chemical frictional pressure losses in the capillary tube resulting from variables due to tube swelling and contractions.

15. The method for obtaining useful, real time bottom-hole oil and gas pressure fluctuations from a production well according to claim 14 wherein said computer records all chemical pressure fluctuations in real time and performs corrective analytical algorithms and instantaneous pressure responses.

16. The method for obtaining useful, real time bottom-hole oil and gas pressure fluctuations from a production well according to claim 15 wherein said computer monitors and records chemical flow in the chemical system and performs corrective analytical algorithms by comparing current data with previously recorded data sets and compensating for system pressure and volume variable errors.

17. The method for obtaining useful, real time bottom-hole oil and gas pressure fluctuations from a production well according to claim 16 wherein the corrective analytical algorithms comprise chemical density, gravity acceleration, flow velocity, tubular roughness, hydraulic head pressures, flow pressure drops due to friction, yield points, well depth, and chemical viscosity.

18. The method according to claim 11 wherein said down-hole pressure fluctuation data samples are compared to a starting data set added into said computer.

19. The method according to claim 18 wherein said data samples representing said down-hole pressure fluctuations are between 95 and 100 percent accurate.

20. The method according to claim 11 further includes the step of maintaining a tracking pressure on the capillary tube and acquiring specific well data generated for comparison with previously acquired extrapolated data derived from equations involving the density of the injectate, chemical acceleration due to gravity, chemical flow velocity, tubing and fitting friction, length and size of the capillary tubing and viscosity of the injectate.

* * * * *